United States Patent [19]

van Vliet et al.

[11] 4,450,383

[45] May 22, 1984

[54] ELECTRIC ARRANGEMENT FOR STARTING AND SUPPLYING A LOW-PRESSURE DISCHARGE LAMP

[75] Inventors: Johannes A. J. M. van Vliet; Auke G. van der Kooi, both of Eindhoven, Netherlands

[73] Assignee: U.S. Philips Corporation, New York, N.Y.

[21] Appl. No.: 392,112

[22] Filed: Jun. 25, 1982

[30] Foreign Application Priority Data

Jul. 24, 1981 [NL] Netherlands ..... 8103507

[51] Int. Cl.[3] ..... H05B 41/18

[52] U.S. Cl. ..... 315/106; 315/101; 315/290; 315/DIG. 5

[58] Field of Search ..... 315/100, 101, 105, 106, 315/289, 290, DIG. 5

[56] References Cited

FOREIGN PATENT DOCUMENTS 2452417 5/1976 Fed. Rep. of Germany ..... 315/106

54-109268 8/1979 Japan ..... 315/106

*Primary Examiner*—Eugene R. LaRoche

*Attorney, Agent, or Firm*—Robert S. Smith

[57] ABSTRACT

The invention relates to starting and supplying a low-pressure discharge lamp which comprises two electrodes between which a main discharge path is formed, a shunt path being electrically in parallel with at least a portion of said main discharge path.

In accordance with the invention the lamp is started by means of a glow-discharge starter which is shunted by a VDR the threshold voltage of which is lower than a value determined by the geometry of the shunt path, and is higher than the minimum voltage for starting a discharge in the main discharge path. The discharge then only starts in the main discharge path.

6 Claims, 3 Drawing Figures

ELECTRIC ARRANGEMENT FOR STARTING AND SUPPLYING A LOW-PRESSURE DISCHARGE LAMP

The invention relates to an electric arrangement for starting and supplying a low-pressure discharge lamp of the type having a discharge space containing a metal vapor and a rare gas, a discharge path in said space between two electrodes, and a shunt path in said space which shunts at least a portion of the discharge path, which shunt path has a thickness H of not more than 2 mm and a length L (in mm), the lamp requiring a minimum of A volts between the electrodes for starting a discharge in the discharge path, the arrangement comprising an inductive stabilisation ballast for connection in series with the discharge path between two terminals intended for connection to an A.C. voltage source.

The invention also relates to a lamp unit including such an electric arrangement.

A known electric arrangement of the above-defined type is, for example, described in the German "Offenlegungsschrift" No. 3,027,535. The said shunt path is formed by a gap which is the result of the simple construction of the lamp described in said publication. Namely, said lamp comprises a glass inner member which is enclosed with some clearance by a glass outer member, thus forming the gap. A disadvantage of that known arrangement is that sometimes, during the starting-procedure of the lamp, a discharge is produced in the gap in spite of the presence of a conducting strip in the lamp. That discharge forms, as it were, a temporary short-circuit of at least a portion of the main discharge path. This results in irregular starting of the discharge in the main discharge path, or the discharge does not start at all. Moreover, in the operating condition of the lamp the discharge in the gap will often maintain itself, which results in an unwanted blackening of portions of the lamp vessel and a low luminous efficacy expressed for example in lumen/watt.

It is an object of the invention to provide an electric arrangement of the type defined in the opening paragraph which prevents such a discharge in the gap and thus avoids the said disadvantages.

According to the invention, there is provided an electric arrangement for starting and supplying a low-pressure discharge lamp of the type having a discharge space containing a metal vapour and a rare gas, a discharge path in said space between two electrodes, and a shunt path in said space which shunts at least a portion of the discharge path, which shunt path has a thickness H of not more than 2 mm and a length L (in mm), the lamp requiring a minimum of A volts between the electrodes for starting a discharge in the discharge path, the arrangement comprising an inductive stabilisation ballast for connection in series with the discharge path between two terminals intended for connection to an A.C. voltage source, and characterized in that the arrangement further comprises a glow discharge starter and a voltage-limiting element each arranged for connection to the lamp in parallel with the discharge path, the said element having a threshold voltage of D volts which satisfies the equations $$\log D < [2 + (\log L/5Hf)], \text{ and}$$

$$A < D,$$

where f is the ratio of the length of the discharge path shunted by the gap to the length of the whole discharge path.

An advantage of this electric arrangement is that the change of the occurrence of a discharge in the shunt path is very small, so that the lamp, inter alia, starts smoothly. A further advantage is that a cheap starter, namely a glow-discharge starter is sufficient.

On the one hand the invention is based on the recognition of the fact that a discharge in the main discharge path can be started in several manners. This may namely be done by producing several voltage pulses between the two lamp electrodes. Thus, with a high voltage pulse a short pulse duration is usually sufficient. With a low voltage pulse, however, there is associated—for the same main discharge path—a longer pulse duration.

On the other hand the invention is based on the recognition of the fact that to avoid the gap breakdown the maximum voltage of the voltage pulse must be taken into consideration. For gaps having a thickness $H \leqq 2$ mm the pulse duration appeared to be less important.

In addition, the invention is based on a combination of the above-mentioned recognitions, namely by using only moderately high voltage pulses having a reasonably long pulse duration for starting of the lamp. In response thereto the discharge in the main discharge path starts, but the discharge in the gap does not. The requirements to be imposed on the voltage pulse for this purpose depend inter alia on the geometry (L,H) of the gap.

By using a combination of a glow-discharge starter and a voltage-limiting circuit element, the recognition obtained can be applied in a simple way. By using the voltage-limiting circuit element it is avoided that the pulses generated by the glow-discharge starter obtain a peak value higher than D volt.

The voltage-limiting circuit element may, for example, be in the form of a series arrangement of two zener diodes with opposite zener directions.

In a preferred embodiment of an electric arrangement in accordance with the invention the voltage-limiting circuit element is a voltage-dependent resistor (VDR).

An advantage of this preferred embodiment is that the voltage-limiting circuit element is formed by only one electric component.

It should be noted that from United Kingdom Patent Specification No. 912,181 it is known per se st shunt a discharge lamp by a voltage-dependent resistor (VDR). However, said patent specification relates to a circuit which does not incorporate a glow-discharge starter. Furthermore, no mention is made of a shunt path in the lamp.

In a further preferred embodiment of an electric arrangement in accordance with the invention the lamp is a low-pressure mercury vapour discharge lamp, and the two electrodes are preheatable, those ends of those electrodes remote from the A.C. voltage source being interconnected by the glow-discharge starter.

An advantage of this preferred embodiment is that owing to the electrode preheating current occurring via the glow-discharge starter the voltage A, which is at least required for starting a discharge in the main discharge path, decreases. This makes it possible to choose a lower value for the threshold voltage D, and that thus the gap thickness H may be greater and/or the gap length L may be smaller. This implies that during the fabrication of the lamp the tolerances on the gap dimensions may be larger.

In a next preferred embodiment of an electric arrangement in accordance with the invention the lamp has a glass inner member which is enclosed by a glass outer member, the main discharge path being formed by a groove in at least one of these members.

An advantage of this preferred embodiment is that a lamp of such a simple construction, whereby the gap is located as a rule between the two members, no longer has the drawback of electric flashover through the gap.

It should be noted that the elimination of the flashover through the gap is done in such an (external) electric manner that there is no need to change the construction of the lamp.

Finally, the invention relates to a lamp unit incorporating an electric arrangement in accordance with the invention and a low-pressure discharge lamp to be started and supplied therewith, the lamp unit having a lamp base with screw cap. An advantage of this lamp is that it can replace an incandescent lamp.

An embodiment of the invention will now be described in detail by way of example with reference to the accompanying drawing.

Figure 1:
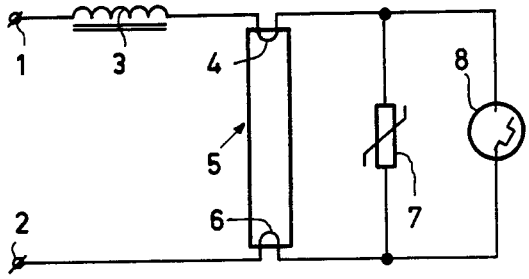
FIG. 1 shows a circuit of an electric arrangement in accordance with the invention, as well as a (schematically shown) low-pressure discharge lamp to be fed with that arrangement.

In FIG. 1, reference numerals 1 and 2 denote input terminals which are intended to be connected to an A.C. voltage source of approximately 220 Volt, 50 Hertz. Via an inductive stabilization-impedance 3 the terminal 1 is connected to a preheatable electrode 4 of a low-pressure mercury vapour discharge lamp 5. A second preheatable electrode 6 of the lamp 5 is connected to the terminal 2. Those ends of the electrodes 4 and 6 remote from the terminals 1 and 2 are interconnected by means of a parallel arrangement of a voltage-dependent resistor (VDR) 7 and a glow-discharge starter 8.

Figure 2:
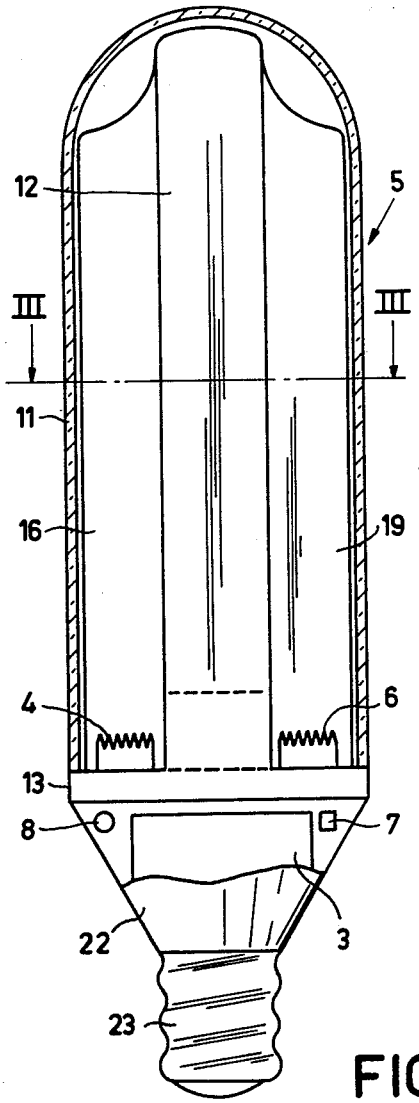
FIG. 2 shows a longitudinal section, partly in an elevational view, through a lamp unit in accordance with the invention, said lamp unit incorporating an electric arrangement and the lamp of FIG. 1.
Figure 3:
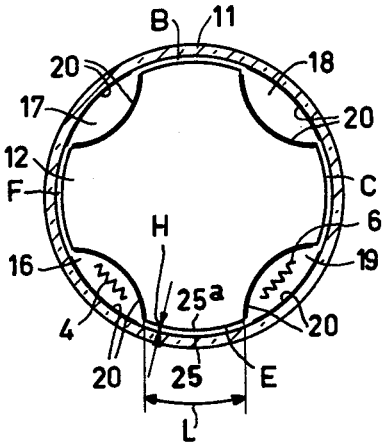
FIG. 3 shows a longitudinal cross-section of the lamp unit shown in FIG. 2 along the plane III—III.

The lamp unit shown in FIG. 2 comprises a cylindrical glass outer member 11, which is closed hemispherically at one end. It encloses a glass inner member 12 with some clearance. The edge 13 located at the other end of the outer member is connected in a gas-tight manner to the edge of the inner member 12 by means of glass enamel. The lamp comprises two electrodes (4 and 6) between which a discharge takes place during operation of the lamp. The main discharge path is folded and is located in a meander-shaped groove located in the outer wall surface of the inner member 12. The groove portions are denoted by 16, 17, 18 and 19 (see also FIG. 3). This main discharge path is surrounded by the groove and those wall portions of the outer member 11 which face the groove. The discharge flows from electrode 4 upwards via groove portion 16, downwards via groove portion 17 and flows via the portions 18 and 19 to electrode 6. Only the groove walls facing the discharge and those portions of the interior wall of the outer member which face the groove are coated with a luminescent layer 20. The lamp has a lamp base 22 with a screw cap 23. The lamp base includes the electric stabilization ballast 3, the glow-discharge starter 8 and the VDR 7.

In a practical embodiment in accordance with the invention a gap having a length L of 12 mm and a thickness H of 0.4 mm (see FIG. 3) is present between the inner member and the outer member in the region of B, C, E and F. The luminescent material 20 consists of a mixture of two phosphors, namely green luminescing terbium-activated cerium magnesium aluminate and red-luminescing, trivalent-europium activated yttrium oxide. The meander-shaped groove extends the discharge path to 40 cm. The discharge space contains approximately 8 mg of mercury, and a rare gas, for example, argon.

The coil 3 has a value of approximately 3 Henry. The threshold value (D) of the VDR 7 is approximately 550 Volts. The pulse duration, when glow-discharge starter 8 strikes, it upwards of 100 microseconds. The minimum starting value A of the lamp after preheating of the electrodes 4 and 6 is approximately 450 Volts. The conditions $$\log D < [2 + \log (L/5Hf)] \text{ and } A < D$$

are then also satisfied as $2.74 < 2 + 0.78$ and $450 < 550$.

It should be noted that the gap E (see FIG. 3), between the portions 16 and 19 of the main discharge path, is the decisive gap because it has the maximum possible voltage across it. For that gap $f = 1$ since gap E shunts whole of the main discharge path.

With rare gas filling of argon (3 torr) the luminous flux as 1000 lumen at an applied power to the lamp (i.e. including the electric ballast) of 19 W. It was found that no flash-over took place in the said gaps.

The discharge in the main discharge path ignited rapidly and smoothly. The said rapid ignition also implies a reduction in the number of starting efforts each time the lamp is switched-on and results therefore also in a prolongation of the life of the lamp. In the region of the gaps no blackening of the wall portions of the two members (for example the portions 25 and 25*a*) occurred.

The luminous efficacy is approximately 50 lumen/watt.

What is claimed is:

1. An electric arrangement for starting and supplying a low-pressure discharge lamp of the type having a discharge space containing a metal vapor and a rare gas, a discharge path in said space between two electrodes, and a shunt path in said space which shunts at least a portion of the discharge path, which shunt path has a thickness H of not more than 2 mm and a length L (in mm), the lamp requiring a minimum of A volts between the electrodes for starting a discharge in the discharge path, the arrangement comprising an inductive stabilization ballast for connection in series with the discharge path between two terminals intended for connection to an A.C. voltage source, characterized in that the arrangement further comprises a glow-discharge starter and a voltage-limiting element each arranged for connection to the lamp in parallel with the discharge path, said element having a threshold voltage of D volts which satisfies the equations $$\log D < [2 + (\log L/5Hf)], \text{ and}$$

$$A < D,$$

where f is the ratio of the length of the discharge path shunted by the gap to the length of the whole discharge path.

2. An electric arrangement as claimed in claim 1 wherein the voltage-limiting element is a voltage-dependent resistor (VDR).

3. A lamp unit as claimed in claim 1, wherein the lamp is a low-pressure mercury vapor discharge lamp and the two electrodes are preheatable, the ends of the two electrodes remoted from said terminals being interconnected by the glow-discharge starter.

4. A lamp unit as claim in claim 2, wherein the lamp is a low-pressure mercury vapor discharge lamp and the two electrodes are preheatable, the ends of the two electrodes remote from said terminals being interconnected by the glow-discharge starter.

5. A lamp unit as claimed in claim 3 or 4, wherein the lamp comprises a glass inner member which is enclosed by a glass outer member, the discharge path being formed by a groove in at least one of the two members.

6. A lamp unit as claimed in any of claim 3 or 4, wherein said arrangement includes a surrounding lamp base.

* * * * *